US012337223B1

(12) United States Patent
Mason et al.

(10) Patent No.: US 12,337,223 B1
(45) **Date of Patent: *Jun. 24, 2025**

(54) GOLF SWING FORCE SHIFT INDICATOR WITH TRAIL FOOT SUPPORT

(71) Applicant: WhyGolf LLC, Escondido, CA (US)

(72) Inventors: Bradley R. Mason, Escondido, CA (US); Jeffrey T. Mason, Escondido, CA (US)

(73) Assignee: WhyGolf LLC, Escondido, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/800,007

(22) Filed: Aug. 10, 2024

(51) Int. Cl.
*A63B 69/36* (2006.01)

(52) U.S. Cl.
CPC ..... *A63B 69/3673* (2013.01)

(58) Field of Classification Search
CPC ..... A63B 69/3673
USPC ..... 473/219, 261, 269, 270, 272, 278, 279
See application file for complete search history.

(56) References Cited

U.S. PATENT DOCUMENTS

| | | | | |
|---|---|---|---|---|
| 3,352,559 | A * | 11/1967 | Larsen | A63B 69/3667 482/146 |
| 7,625,294 | B1 * | 12/2009 | Isaac | A63B 69/3667 473/218 |
| 11,969,639 | B1 * | 4/2024 | Mason | A63B 69/3673 |
| 2009/0029789 | A1 * | 1/2009 | Davies | A63B 69/3667 473/218 |

* cited by examiner

*Primary Examiner* — Nini F Legesse
(74) *Attorney, Agent, or Firm* — CP LAW GROUP PC; Cy Bates

(57) ABSTRACT

A golf swing force shift indicator with a trail foot support includes both monolithic and detachable configurations to provide increased leverage and support to a golfer's trail foot during use of the golf swing force shift indicator. The golf swing force shift indicator includes a top face and a bottom face opposite the top face. The top face is where the golfer places their lead foot near a front face. The bottom face is configured to have various angular orientations during a golf swing. The trail foot support is disposed at a rear face opposite the front face. The trail foot support forms an upward incline relative to the top face where the golfer can place their trail foot on the trial foot support.

20 Claims, 16 Drawing Sheets

GOLF SWING FORCE SHIFT INDICATOR WITH TRAIL FOOT SUPPORT

BACKGROUND

Field of the Invention

This invention relates to generally to the sport of golf; more particularly, to devices used to improve a golf swing.

Description of the Related Art

An important element of a golf swing is the ability of a golfer to properly shift the majority of the golfer's downward force directed against the ground from one foot to the other at appropriate stages of the swing. This swing element is particularly important in the long game where the golfer is taking a full swing off the tee or fairway. As a general rule, a golfer desirably applies the majority of the golfer's downward force with the trail foot during the backswing and applies the majority of the golfer's downward force with the lead foot during the downswing. The mechanics of the backswing and downswing stages of a golf swing are disclosed in greater detail in U.S. Pat. No. 11,389,707 having the same inventors, which is incorporated herein by reference.

As such, there was a need for a device that confirms that a golfer is applying the correct downward force loading to the appropriate foot at the appropriate stage of the swing, as well as enable a golfer to achieve an optimal golf swing by providing the golfer with a real time indication of properly shifting from a balanced downward force distribution to an unbalanced rearward-dominant downward force distribution during the backswing, as well as a real time indication of properly shifting from the unbalanced rearward-dominant downward force distribution to an unbalanced forward-dominant downward force distribution during the downswing.

U.S. Pat. No. 11,969,639 was designed to meet these needs and is incorporated herein by reference. U.S. Pat. No. 11,969,639 is directed to a device that indicates to a user when the user has properly shifted a sufficient amount of his or her downward force to the trail foot and thereafter to the lead foot during the course of a golf swing, thereby effecting an optimal golf swing. However, there is a need for an improved device that provides a more balanced swing and better mimics the distribution of weight during a golf swing.

SUMMARY

The disclosure concerns a golf swing force shift indicator with a trail foot support including both monolithic and detachable configurations. The trail foot support is configured to provide increased leverage and support to a golfer's trail foot during use of the golf swing force shift indicator. The golf swing force shift indicator comprises a top face and a bottom face opposite the top face. The top face is where the golfer places their lead foot near a front face. The bottom face is configured to have various angular orientations during a golf swing. The trail foot support is disposed at a rear face opposite the front face. The trail foot support forms an upward incline relative to the top face where the golfer can place their trail foot on the trial foot support.

BRIEF DESCRIPTION OF THE DRAWINGS

Other features, combinations, and embodiments will be appreciated by one having the ordinary level of skill in the art of golf and accessories upon a thorough review of the following details and descriptions, particularly when reviewed in conjunction with the drawings, wherein.

DETAILED DESCRIPTION

Figure 1:
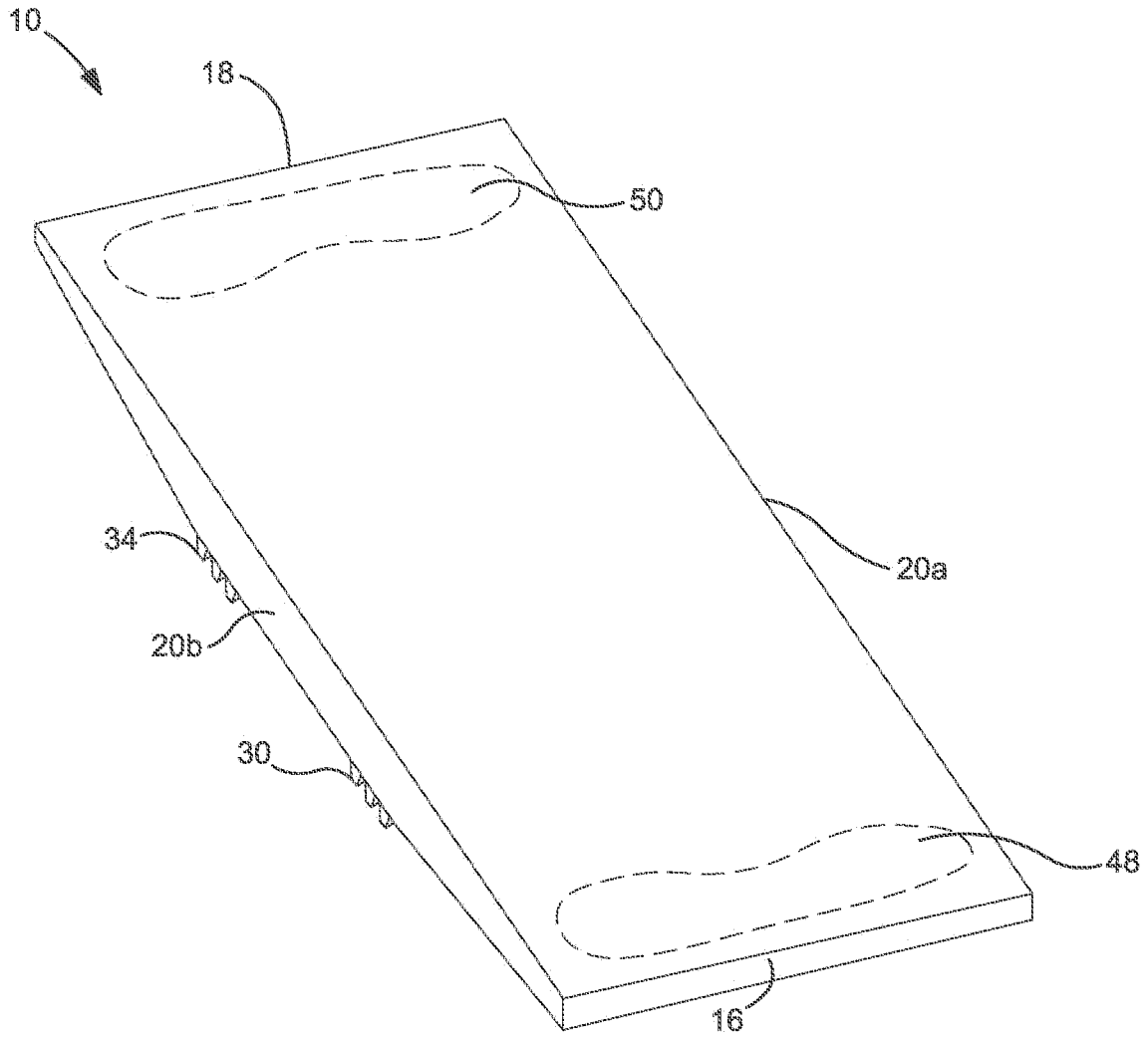
FIG. 1 shows a perspective view of a conventional golf swing force shift indicator.
Figure 2:
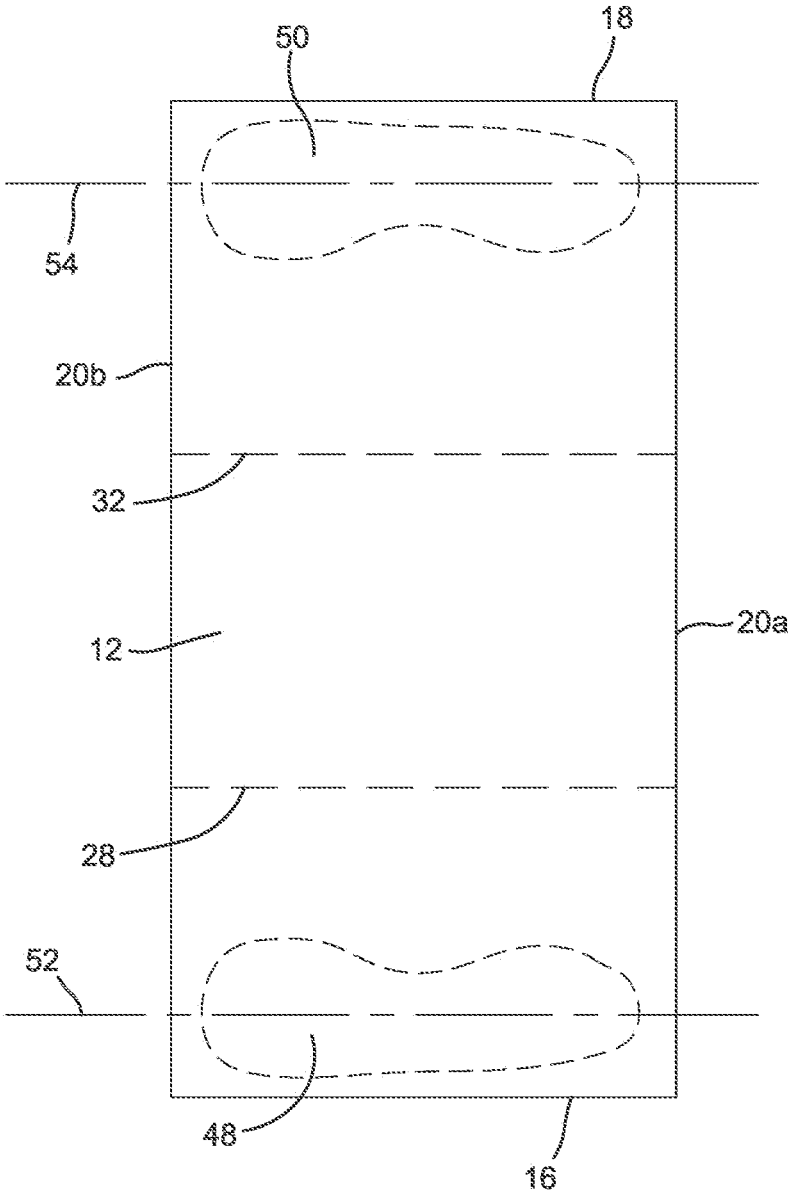
FIG. 2 shows a top plan view of the conventional golf swing force shift indicator.
Figure 3:
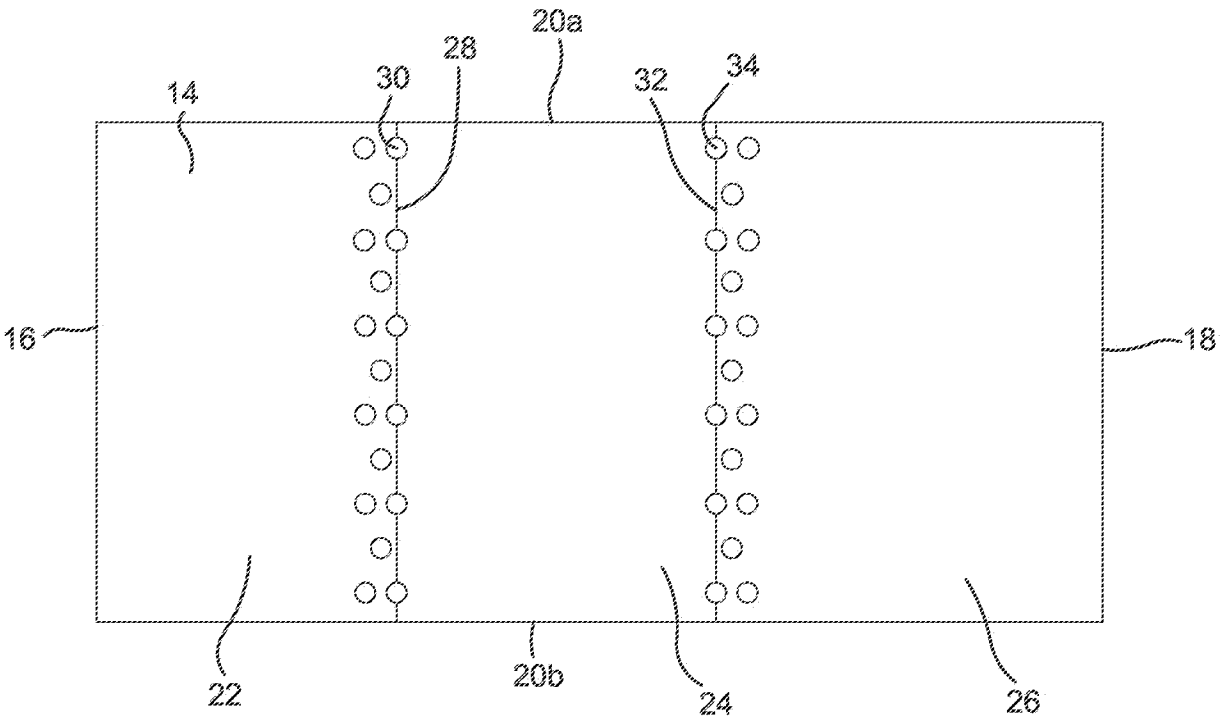
FIG. 3 is a bottom plan view of the conventional golf swing force shift indicator.
Figure 4:
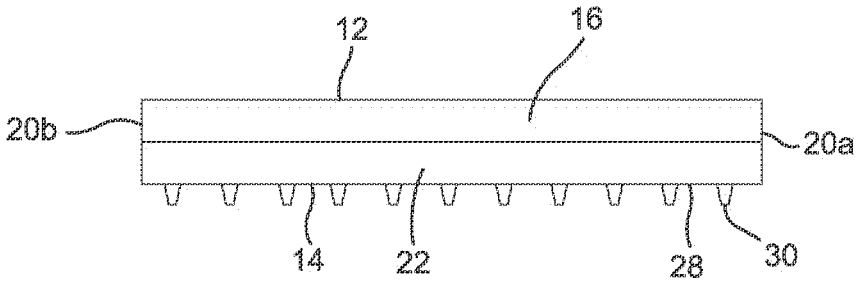
FIG. 4 is a front elevation view of the conventional golf swing force shift indicator.
Figure 5:
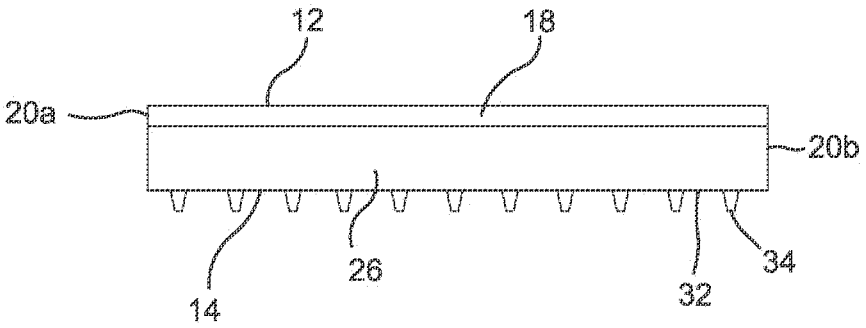
FIG. 5 is a rear elevation view of the conventional golf swing force shift indicator.
Figure 6:
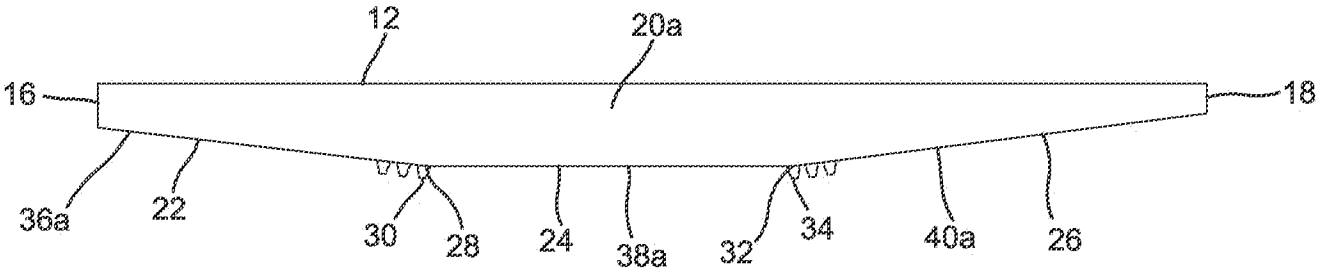
FIG. 6 is a first side elevation view of the conventional golf swing force shift.
Figure 7:
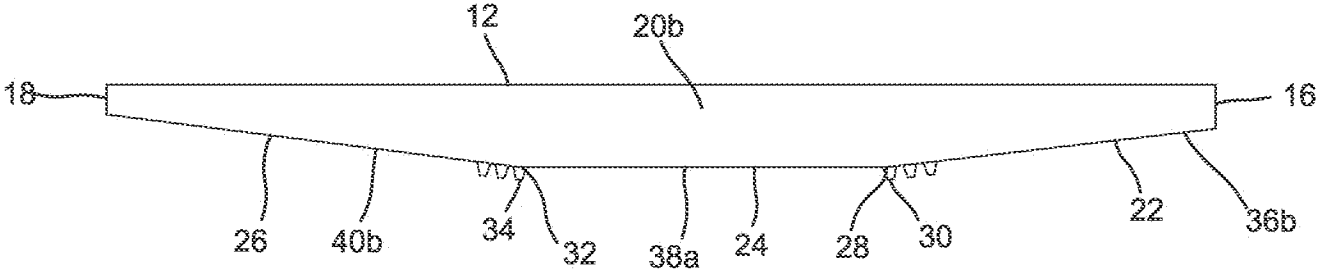
FIG. 7 is a second side elevation view of the conventional golf swing force shift indicator.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

For purposes herein, the term "askew" means not parallel

Unless explicitly defined herein, terms are to be construed in accordance with the plain and ordinary meaning as would be appreciated by one having skill in the art.

General Description of Embodiments

In one general embodiment, a golf swing force shift indicator is disclosed. The golf swing force shift indicator comprises a top face, a bottom face, a front face positioned at a front end of said force shift indicator and a rear face positioned at a rear end of said force shift indicator, wherein said bottom face extends from said front end to said rear end. A lead foot placement site is disposed on the top face, the lead foot placement site having a longitudinal centerline positioned more proximal to the front end than to the rear end. A bottom front plane, a bottom central plane, and a bottom rear plane form said bottom face, wherein said bottom front, central and rear planes are sequentially positioned relative to one another in a series along the length of said bottom face. The bottom central plane intersects the bottom front plane along a forward pivot axis and the bottom central plane intersects the bottom rear plane along a rearward pivot axis. The bottom front plane comprises a bottom front length extending from the forward pivot axis to the front face, the bottom rear plane comprising a bottom rear length extending from the rearward pivot axis to the rear face, wherein the bottom rear length is greater than the bottom front length. The golf swing force shift indicator further comprises a trail foot support wherein the top face comprises a first section having a first continuous unitary plane and a second section having a second continuous unitary plane wherein the second section comprises the trail foot support. The first section extends from the front end to the second section, and the second section extends from the rear end to the first section. An intersection of the first section and the second section forms a top face angle.

In some embodiments, the trail foot support may be askew with the bottom central plane.

In some embodiments, the trail foot support may be disposed vertically above a portion of the bottom rear plane.

In some embodiments, the top face angle may be greater than 90 degrees and less than 180 degrees. In other embodiments, the top face angle comprises an angle between and inclusive of 150 degrees and 189 degrees.

In some embodiments, the trail foot support may be detachable from the golf swing force shift indicator.

In some embodiments, the trail foot support may be monolithically integrated with the golf swing force shift indicator.

In another general embodiment, a golf swing force shift indicator is disclosed. The golf swing force shift indicator comprises a top face, a bottom face, a front face positioned at a front end of said force shift indicator and a rear face positioned at a rear end of said force shift indicator, wherein said bottom face extends from said front end to said rear end. A lead foot placement site is disposed on the top face, the lead foot placement site having a longitudinal centerline positioned more proximal to the front end than to the rear end. A bottom front plane, a bottom central plane, and a bottom rear plane form the bottom face, wherein said bottom front, central and rear planes are sequentially positioned relative to one another in a series along the length of said bottom face. The bottom central plane intersects said bottom front plane along a forward pivot axis and the bottom central plane intersects said bottom rear plane along a rearward pivot axis. The bottom front plane comprises a bottom front length extending from the forward pivot axis to the front face, and the bottom rear plane comprises a bottom rear length extending from the rearward pivot axis to the rear face. The bottom rear length is greater than the bottom front length. A portion of the top face is askew with the bottom central plane.

In some embodiments, the portion of the top face askew with the bottom central plane may be disposed vertically above a portion of the bottom rear plane.

In some embodiments, the bottom central plane may be parallel to a first section of the top plane and askew with a second section of the top plane.

In some embodiments, the first section may comprise a first continuous unitary plane and the second section may comprise a second continuous unitary plane wherein the second section comprises a trail foot support, The first section extends from the front end to the second section, and the second section extends from the rear end to the first section. An intersection of the first section and the second section forms a top face angle.

In some embodiments, the top face angle may be greater than 90 degrees and less than 180 degrees. In other embodiments, the top face angle may comprise an angle between and inclusive of 150 degrees and 189 degrees.

In some embodiments, the trail foot support may be detachable from the golf swing force shift indicator.

In some embodiments, the trial foot support may be monolithically integrated with the golf swing force shift indicator.

In some embodiments, the golf swing force shift indicator may further comprise a handle opening extending through the top face and the bottom rear face, the handle opening comprising an inner contact surface and a gripping portion extending from the handle opening to the rear face, and a detachable trail foot support engaged with the inner contact surface of the handle opening.

In some embodiments, the detachable trail foot support may comprise a top surface and a bottom surface, the top surface comprises a downward slant relative to the bottom surface to form a back heel and a front edge.

In some embodiments, the bottom surface may comprise a coupler element having an outer perimeter engaged to and forming a friction fit with the inner contact surface.

In some embodiments, the detachable trail foot support may further comprise one or more support flanges disposed at the back heel, wherein each of the one or more support flanges is engaged to and forms a friction with the rear face.

In some embodiments, wherein the gripping portion may be disposed between the coupler element and the one or more support flanges.

In some embodiments, the back heel may overhang the rear face.

In some embodiments, the front edge may abut the top face.

In another general embodiment, a golf swing force shift indicator kit is disclosed. The kit comprises a golf swing force shift indicator comprising a top face, a bottom face, a front face positioned at a front end of said force shift indicator and a rear face positioned at a rear end of said force shift indicator, wherein said bottom face extends from said front end to said rear end; a lead foot placement site disposed on the top face, the lead foot placement site having a longitudinal centerline positioned more proximal to the front end than to the rear end; and a bottom front plane, a bottom central plane, and a bottom rear plane forming said bottom face, wherein said bottom front, central and rear planes are sequentially positioned relative to one another in a series along the length of said bottom face, said bottom central plane intersects said bottom front plane along a forward pivot axis and said bottom central plane intersects said bottom rear plane along a rearward pivot axis, the bottom front plane comprising a bottom front length extending from the forward pivot axis to the front face, the bottom rear plane comprising a bottom rear length extending from the rearward pivot axis to the rear face, wherein the bottom rear length is greater than the bottom front length. The kit further comprises a detachable trail foot support.

In some embodiments, the golf swing force shift indicator may further comprise a handle opening extending through the top face and the bottom rear face, the handle opening comprising an inner contact surface and a gripping portion extending from the handle opening to the rear face, wherein the detachable trail foot support is configured to engage with the inner contact surface of the handle opening.

In some embodiments, the detachable trail foot support may comprise a top surface and a bottom surface, the top surface comprises a downward slant relative to the bottom surface to form a back heel and a front edge.

In some embodiments, the bottom surface may comprise a coupler element having an outer perimeter configured to engage and form a friction fit with the inner contact surface.

In some embodiments, the detachable trail foot support may further comprise one or more support flanges disposed at the back heel, wherein each of the one or more support flanges is configured to engage and form a friction with the rear face.

In some embodiments, the gripping portion may be configured to be disposed between the coupler element and the one or more support flanges.

In some embodiments, the back heel may be configured to overhang the rear face.

In some embodiments, the front edge may be configured to abut the top face.

Manufacturing

Generally, the golf swing force shift indicator and the trail foot support can made of materials including thermoplastics, metal, wood, or a combination thereof. Otherwise, the golf swing force shift indicator and the trail foot support can be fabricated in accordance with the level and knowledge of one having skill in the art.

Each of the components of the golf swing force shift indicator and trail foot support described herein may be manufactured and/or assembled in accordance with the conventional knowledge and level of a person having skill in the art.

While various details, features, combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

Conventional Golf Swing Force Shift Indicator

FIGS. 1-7 show a conventional golf swing force shift indicator (10). The golf swing force shift indicator is a three-dimensional solid having the approximate configuration of a six-sided rectangular cuboid. As such, the golf swing force shift indicator is bounded by six planar faces, namely, a top face (12), a bottom face (14), a front face (16), a rear face (18), a first lateral face (20*a*) and a second lateral face (20*b*). The top face and the bottom face are on opposing sides of the golf swing force shift indicator. The top face faces upward and the bottom face faces downward when the golf swing force shift indicator is in use. The precise angular orientations of the top and bottom faces vary during use of the golf swing force shift indicator, but both of their orientations are much closer to horizontal than vertical at all times during use as described below. As such, the angular orientations of the top and bottom faces may be characterized as substantially horizontal, wherein the term "substantially horizontal" encompasses true horizontal and deviations less than 45° from true horizontal.

The front face (16) and the rear face (18) are on opposing sides of the golf swing force shift indicator (10), preferably in parallel vertical alignment with one another. The front and rear faces maintain a substantially vertical orientation during use of the golf swing force shift indicator, wherein the term "substantially vertical" encompasses true vertical and deviations less than 45° from true vertical. The front face faces forward and the rear face faces backward when the golf swing force shift indicator is in use. The height of the front face corresponds to the thickness of the golf swing force shift indicator at its front end and the height of the rear face corresponds to the thickness of the golf swing force shift indicator at its rear end. Each of the top face (12), front face, and rear face is a single substantially continuous unitary plane having a substantially rectangular profile. The top face intersects each of the front face, rear face, first lateral face (20*a*), and second lateral face (20*b*) at right angles and the intersections are straight lines that define the top edges of the golf swing force shift indicator.

Unlike the top face (12) that consists in its entirety of a single continuous unitary plane, the bottom face (14) comprises three discrete rectangular planes, namely, a bottom front plane (22), a bottom central plane (24) and a bottom rear plane (26). The three bottom planes are sequentially positioned in a series along a length of the bottom face. Each of the front, central, and rear bottom planes have a same width, corresponding to a constant width of the top face. However, the bottom front plane and the bottom rear plane each has a different length relative to the other, namely the bottom rear plane comprises a greater length that the bottom front plane. The bottom front plane also has a different angular orientation relative to the bottom central plane compared to an angular orientation of the bottom rear plane relative to the bottom central plane. The bottom rear plane likewise has a different angular orientation relative to the bottom central plane.

The bottom central plane (24), which is connectively positioned between the bottom front plane (22) and the bottom rear plane (26), is aligned parallel to the top face (12). Consequently, the distance between the bottom central plane and the top face 12, i.e., the thickness of the golf swing force shift indicator (10), is constant along the entire length of the bottom central plane. The bottom central plane intersects the bottom front plane (22) along a forward line of intersection termed a forward pivot axis (28) that extends widthwise across the bottom face (14) substantially perpendicular to the longitudinal axis of the golf swing force shift indicator and substantially parallel to the front face (16). The bottom front plane extends forwardly away from the bottom central plane and the forward pivot axis toward the front end of the golf swing force shift indicator which is one and the same as the front face (16). The front end and front face of the golf swing force shift indicator are alternately termed the lead end and lead face, respectively.

The bottom front plane (22) is oriented at an upward angle relative to true horizontal. This upward angle is termed a forward angle of incline. Consequently, the distance between the bottom front plane and the top face (12), i.e., the thickness of the golf swing force shift indicator (10), decreases as the bottom front plane approaches the front end of the golf swing force shift indicator. The forward pivot axis (28) functions as a forward fulcrum enabling the front end of the golf swing force shift indicator to rotate up or down about the forward pivot axis when the golf swing force shift indicator is in use. A plurality of short, narrow, tapered, spike-like forward projections (30) are preferably integrally formed on the bottom face (14), extending downwardly from the forward pivot axis. The forward projections are arranged in an array of three longitudinally spaced apart rows in the present embodiment. One row is positioned directly on the forward pivot axis in substantially perpendicular alignment with the bottom central plane (24) and the remaining two rows are positioned immediately adjacent to the forward pivot axis on the bottom front plane side thereof.

The bottom central plane (24) intersects the bottom rear plane (26) along a rearward line of intersection termed a rearward pivot axis (32) that extends widthwise across the bottom face (14) substantially perpendicular to the longitudinal axis of the golf swing force shift indicator (10) and substantially parallel to the rear face (18). As such, the forward pivot axis (28) and the rearward pivot axis are aligned substantially parallel to one another. The bottom rear plane extends rearwardly away from the rearward pivot axis and bottom central plane toward the rear end of the golf swing force shift indicator, which corresponds to the rear face. The rear end and rear face of the golf swing force shift indicator are alternately termed the trail end and trail face, respectively.

The bottom rear plane (26) is oriented at an upward angle relative to true horizontal. This upward angle is termed a rearward angle of incline. In sum, when the golf swing force shift indicator (10) is aligned such that the top face (12) has a true horizontal orientation, the bottom central plane (24) likewise has a true horizontal orientation while the upward angles of orientation of the bottom front plane (22) and the bottom rear plane, i.e., the forward and rearward angles of incline, deviate from true horizontal. More particularly, the forward and rearward angles of incline are acute angles that are preferably substantially less than about 30° and are preferably about equal to one another.

The distance between the bottom rear plane (26) and the top face (12), i.e., the thickness of the golf swing force shift indicator (10), decreases as the bottom rear plane approaches the rear end. The rearward pivot axis (32) functions as a rearward fulcrum enabling the rear end of the golf swing force shift indicator to rotate up or down about the rearward pivot axis when the golf swing force shift indicator is in use. A plurality of rearward projections (34), configured and dimensioned identically to the forward projections (30), are preferably integrally formed on the bottom face (14), extending downwardly from the rearward pivot axis. The rearward projections are arranged in an array of three longitudinally spaced apart rows in the present embodiment. One row is positioned directly on the rearward pivot axis in substantially perpendicular alignment with the bottom central plane (24) and the remaining two rows are positioned immediately adjacent to the rearward pivot axis on the bottom rear plane thereof. An exemplary preferred length of each projection is on the order of about ⅜ inch.

The first lateral face (20*a*) and second lateral face (20*b*) are longitudinally oriented on opposing sides of the golf swing force shift indicator (10) facing opposite directions from one another. The lateral faces are in substantially parallel vertical alignment with one another and are each preferably aligned substantially perpendicular to the front face (16) and the rear face (18). The lateral faces preferably maintain a constant true vertical orientation during use of the golf swing force shift indicator. Each lateral face is a substantially continuous unitary plane. Although each lateral face preferably has an identical profile, it is not a precisely rectangular profile. The height of the lateral faces at each point along their length corresponds to the thickness of the golf swing force shift indicator at that point. The thickness of the golf swing force shift indicator differs depending on the point along the length of the lateral faces where the thickness is measured.

The bottom face (14) intersects each of the front face (16), the rear face (18), the first lateral face (20*a*), and the second lateral face (20*b*). These intersections define the bottom edges of the golf swing force shift indicator (10). The bottom face appears to have substantially the same rectangular profile in the plan view as the top face (12) with four straight linear edges. However, it is apparent when referencing the side elevation views of the first and second lateral faces that the bottom edges of the first and second lateral faces which are correspondingly the lateral edges of the bottom face, are in reality each made up of three distinct non-collinear line segments that are connected end to end in sequence rather than being a single straight line.

The first lateral face (20*a*) has a first bottom front line segment (36*a*), a first bottom central line segment (38*a*), and a first bottom rear line segment (40). The second lateral face (20*b*) correspondingly has a second bottom front line segment (36*b*), a second bottom central line segment (38*b*), and a second bottom rear line segment (40*b*). The first and second bottom front line segments are the intersections of the first and second lateral faces and the bottom front plane (22), respectively. The first and second bottom central line segments are the intersections of the first and second lateral faces and the bottom central plane (24), respectively. The first and second bottom rear line segments are the intersections of the first and second lateral faces and the bottom rear plane (26), respectively. The intersections of the first and second lateral faces and the bottom central plane, respectively, form right angles. The intersection of the first lateral face and the front face (16), of the first lateral face and the rear face (18), of the second lateral face and the front face and of the second lateral face and rear face, respectively, all form right angles. All of the above-recited intersections are straight lines which in total define the side edges of the golf swing force shift indicator (10).

The golf swing force shift indicator (10) is a rigid article that does not substantially flex or otherwise deform when subjected to forces applied to it by a user standing on the top face (12) and swinging a golf club. The user's lead foot is disposed on a lead foot placement site (48) and the trail foot is disposed on a trail foot placement site (50). The golf swing force shift indicator preferably has a unitary solid construction and is preferably fabricated from a rigid, high-strength, durable plastic. The golf swing force shift indicator is preferably manufactured by molding the material of fabrication into the desired configuration. It is noted that the configuration and dimensions of the golf swing force shift indicator are selected by the designer thereof and all are essentially permanently fixed upon manufacture of the golf swing force shift indicator.

First Illustrated Embodiment

Figure 8:
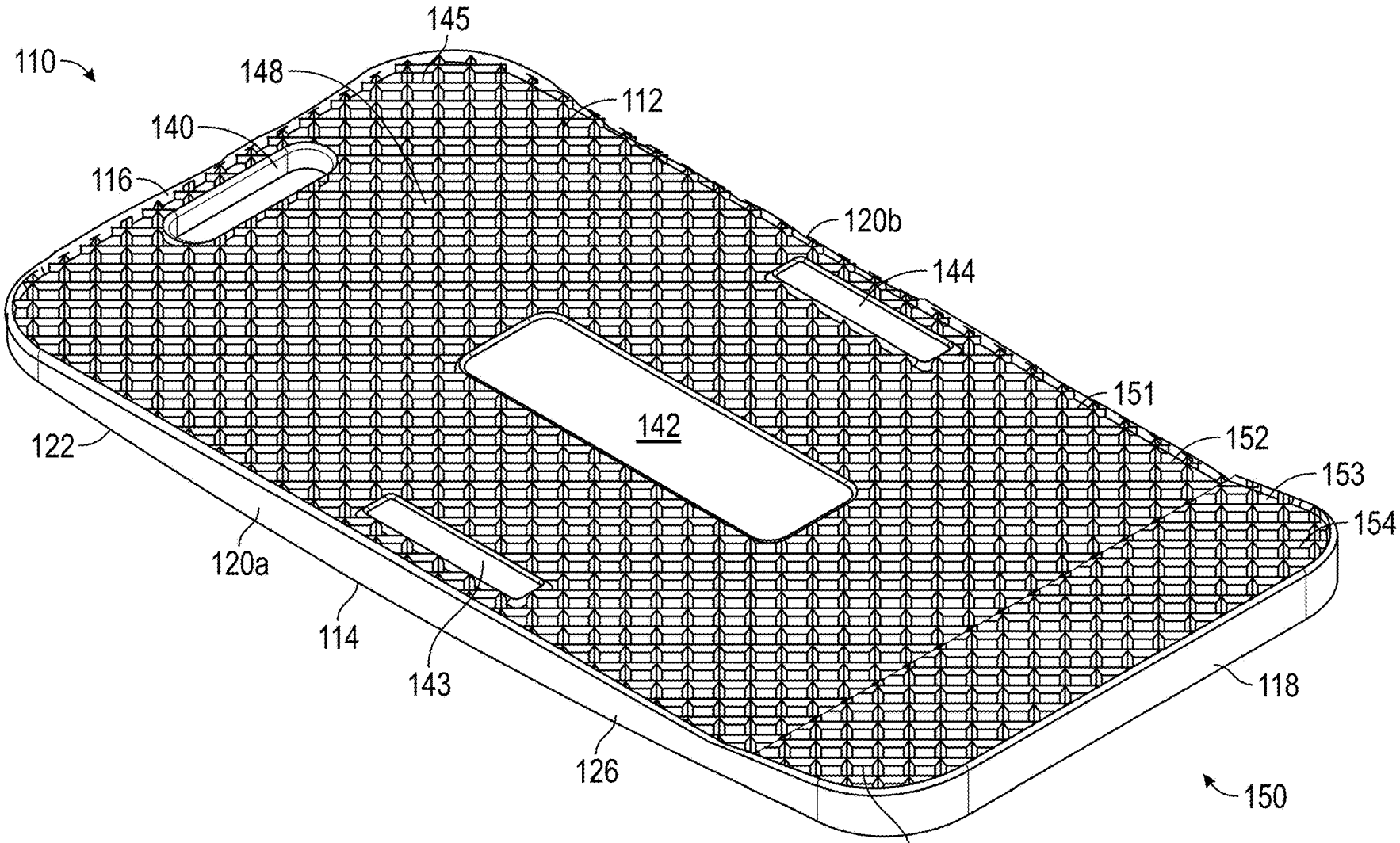
FIG. 8 shows perspective view of a golf swing force shift indicator in accordance with a first illustrated embodiment.
Figure 9:
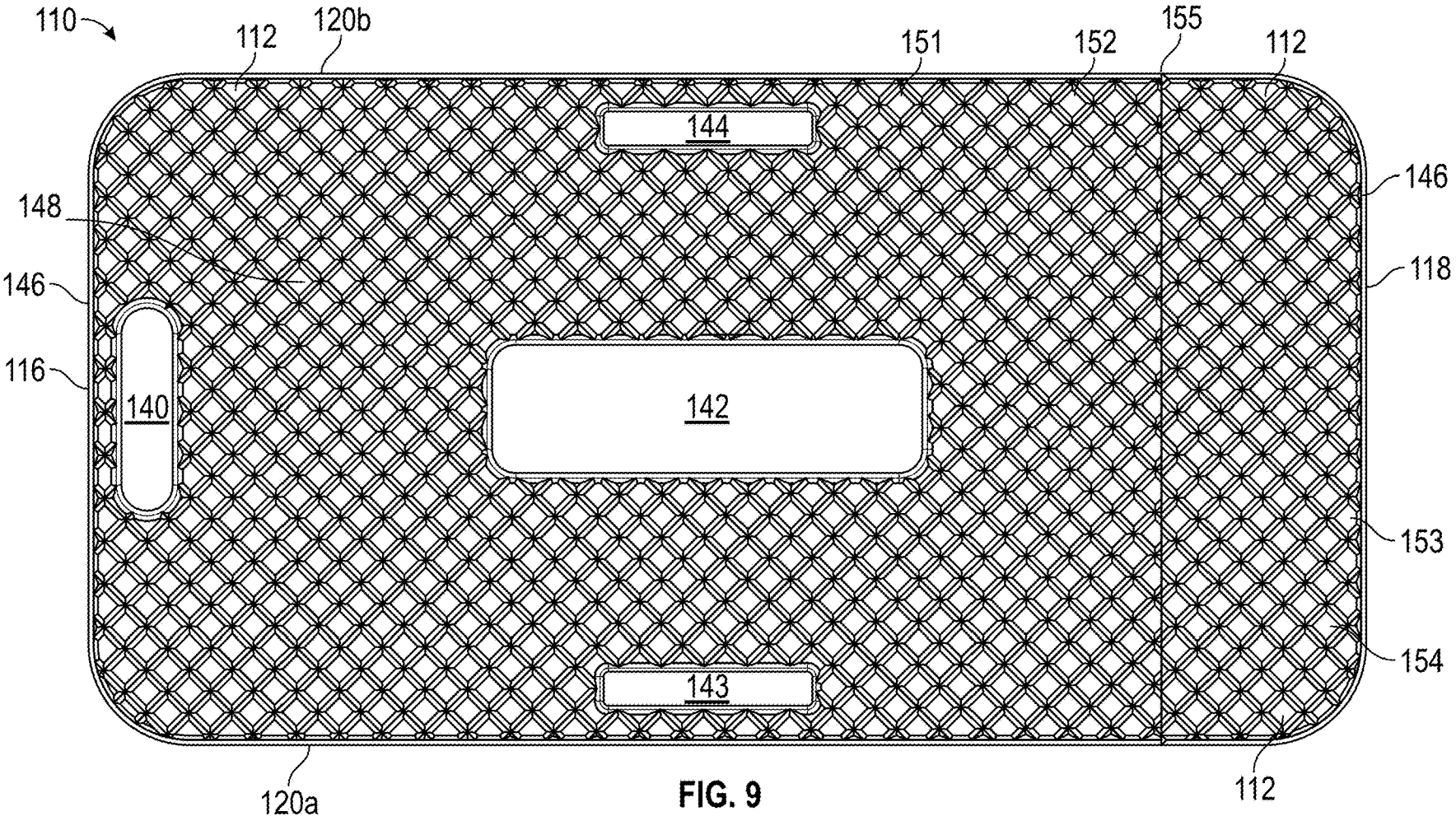
FIG. 9 shows a top view of the golf swing force shift indicator according to the first illustrated embodiment.
Figure 10:
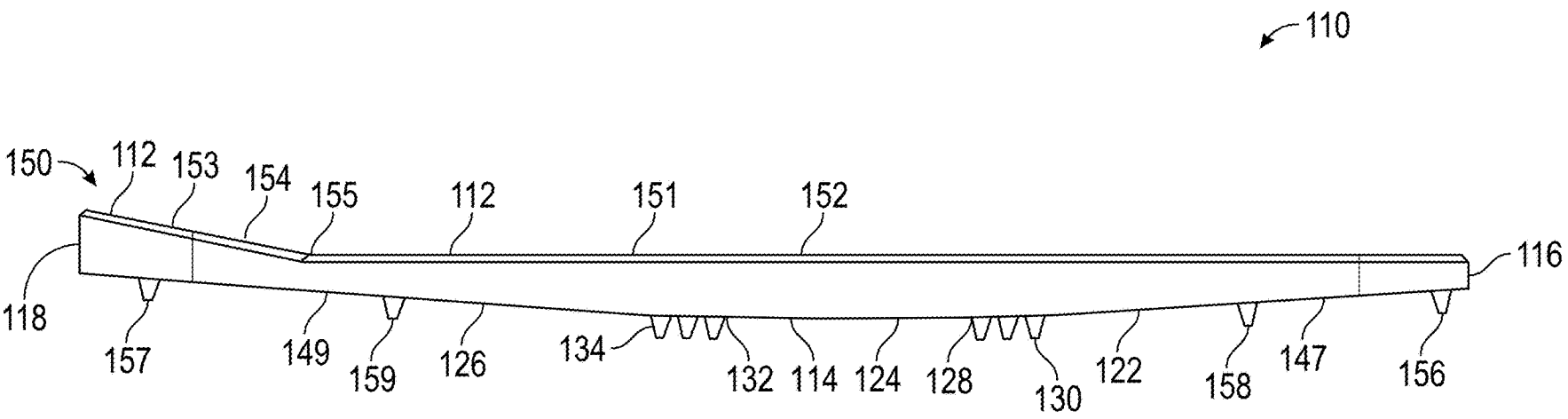
FIG. 10 shows a side view of the golf swing force shift indicator according to the first illustrated embodiment.
Figure 11:
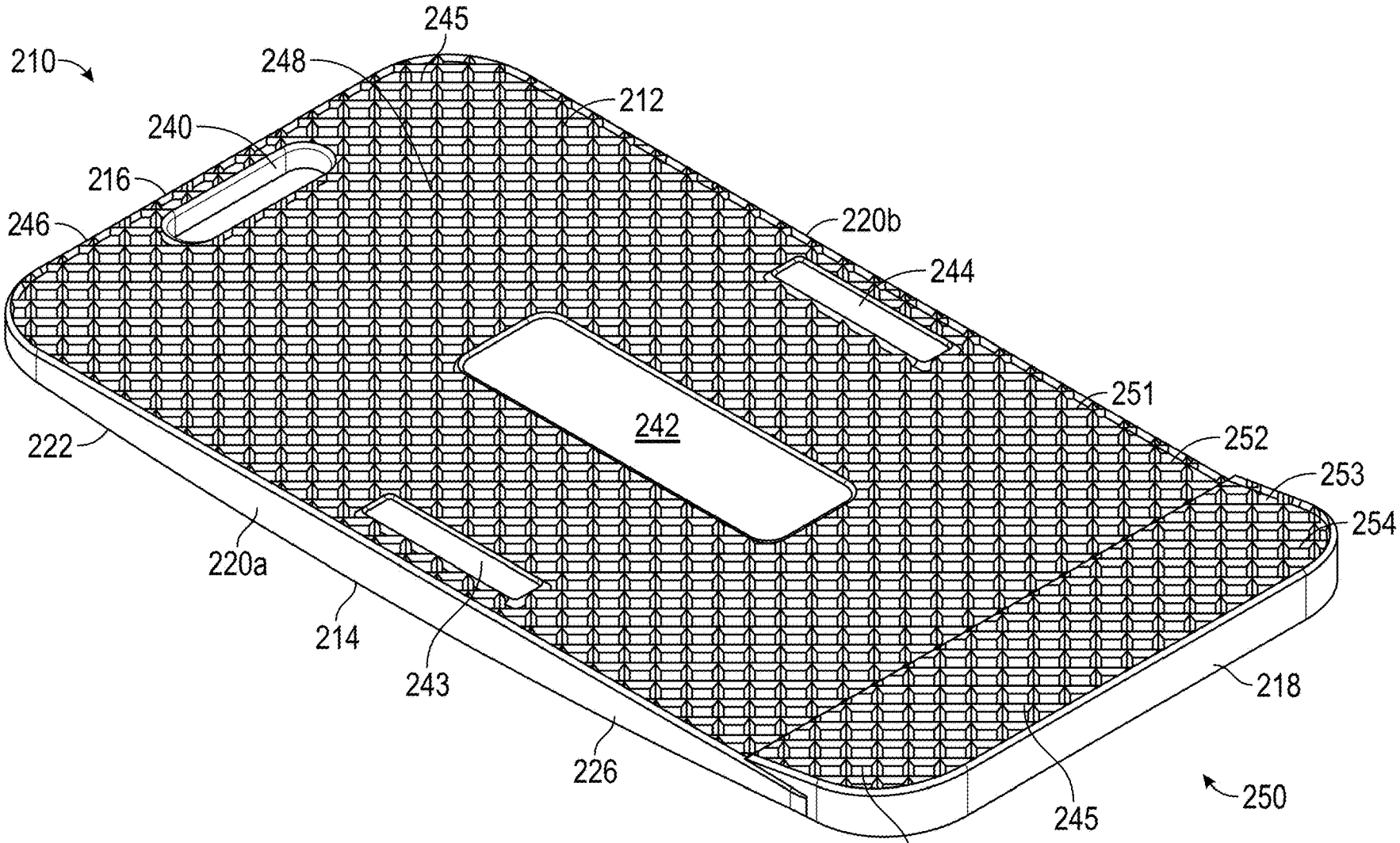
FIG. 11 shows a perspective view of a golf swing force shift indicator in accordance with a second illustrated embodiment.
Figure 12:
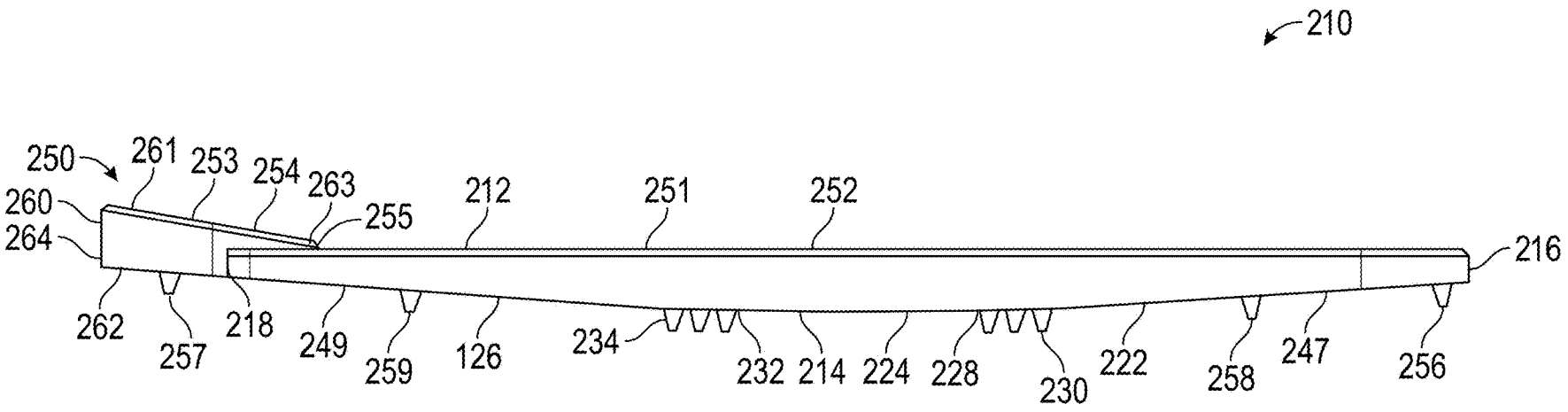
FIG. 12 shows a side view of the golf swing force shift indicator according to the second illustrated embodiment.
Figure 13:
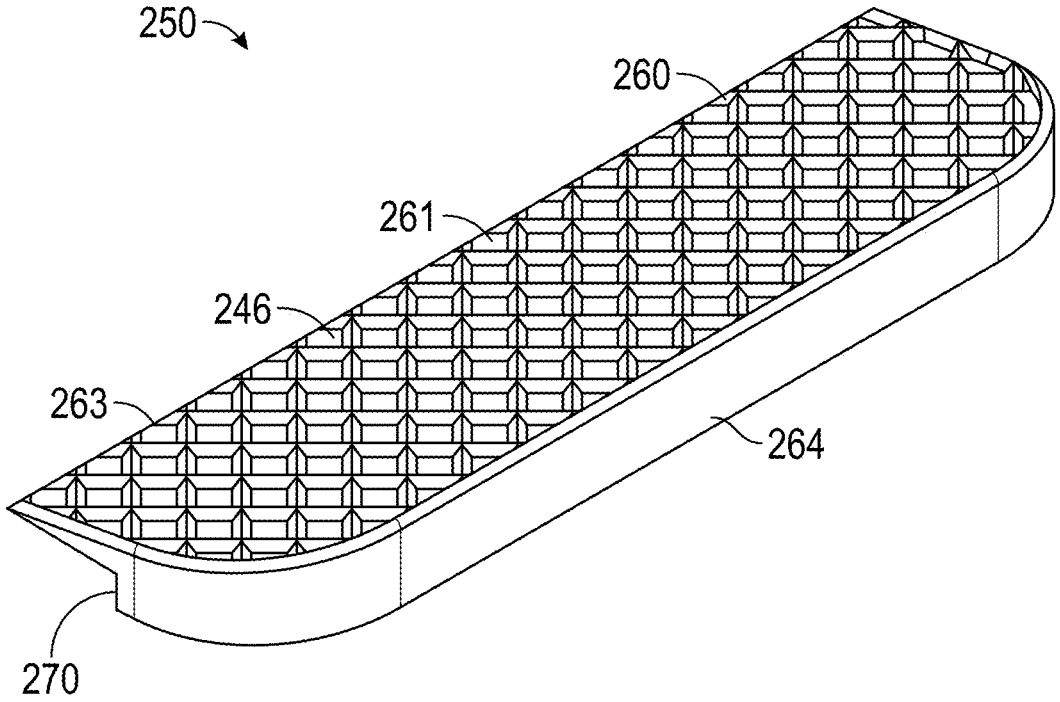
FIG. 13 shows a perspective view of a trail foot support according to the second illustrated embodiment.
Figure 14:
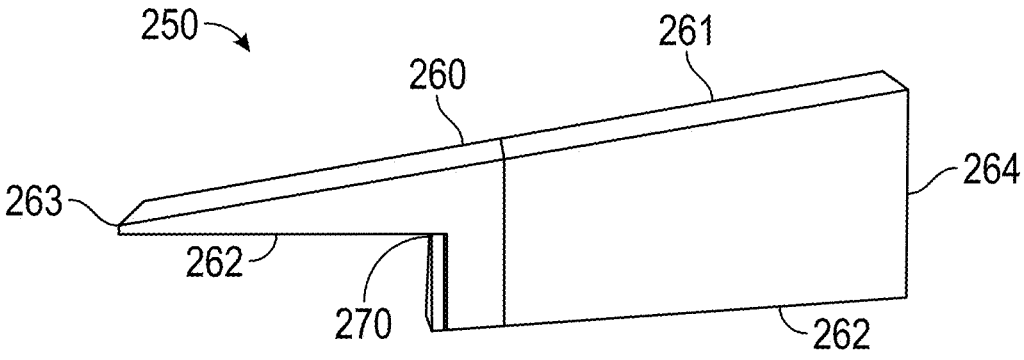
FIG. 14. shows a side view of the trail foot support according to the second illustrated embodiment.
Figure 15:
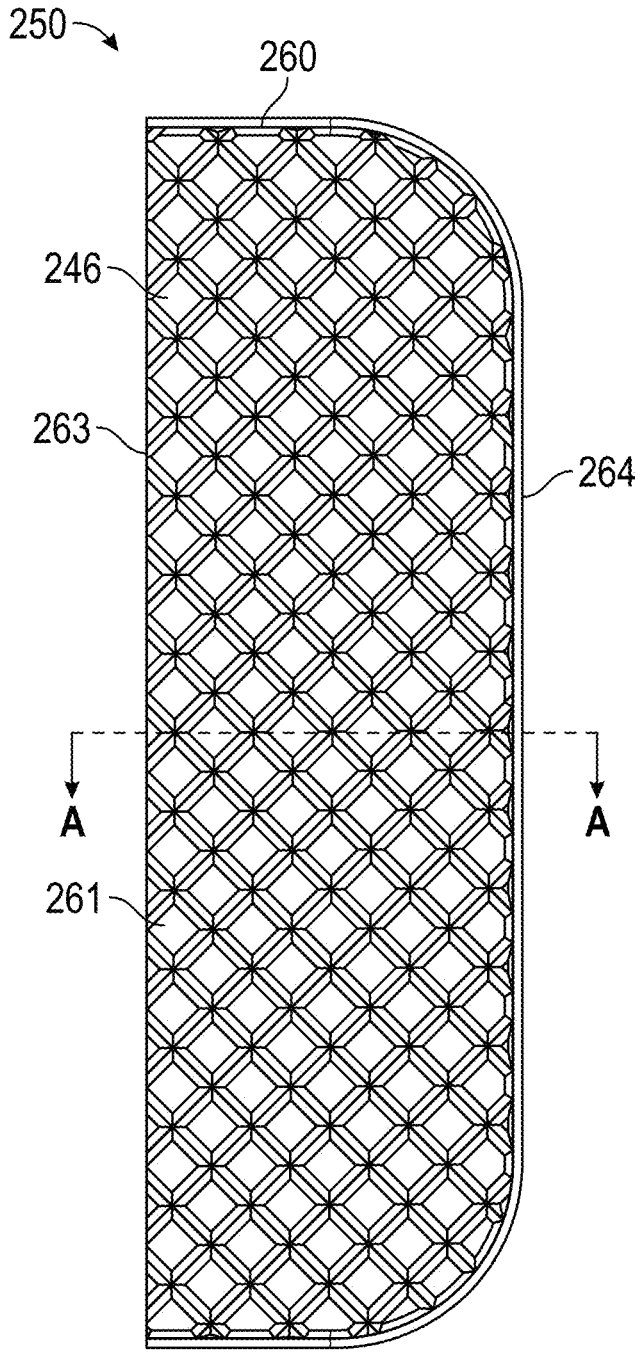
FIG. 15 shows a top view of the trail foot support according to the second illustrated embodiment.
Figure 16:
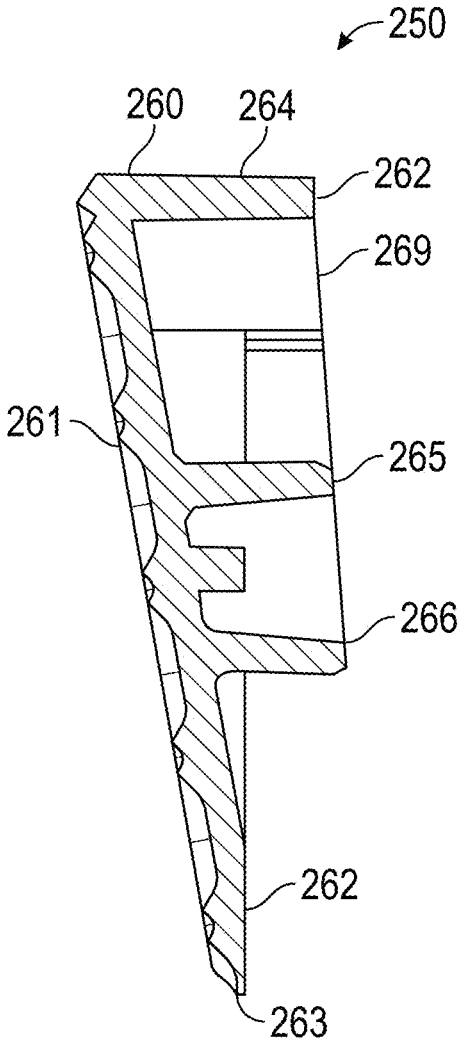
FIG. 16 shows a cross-section view of the trail foot support according to the second illustrated embodiment.
Figure 17:
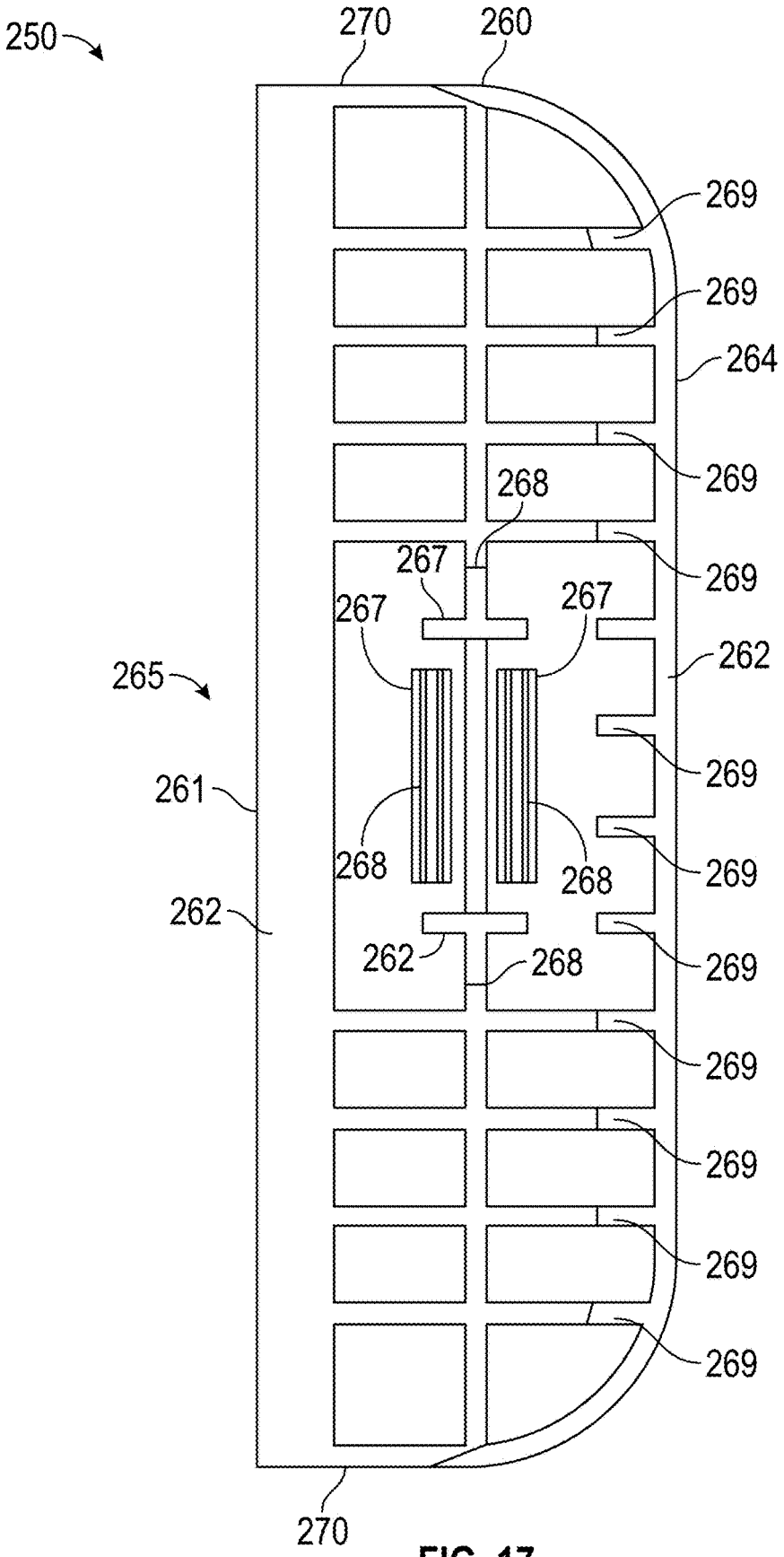
FIG. 17 shows a bottom view of the trail foot support according to the second illustrated embodiment.
Figure 18:
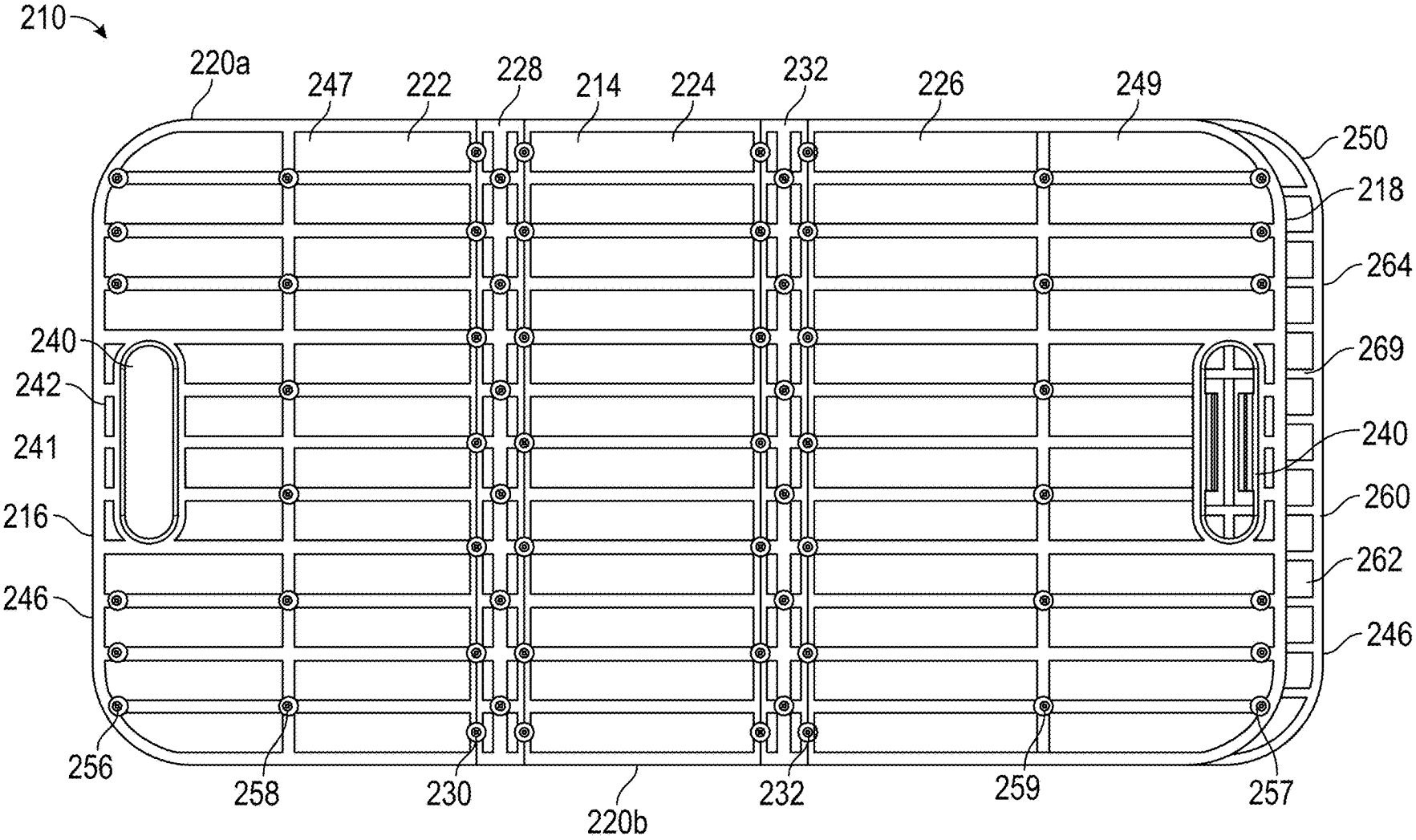
FIG. 18 shows a bottom view of the golf swing force shift indicator according to the second illustrated embodiment.
Figure 19:
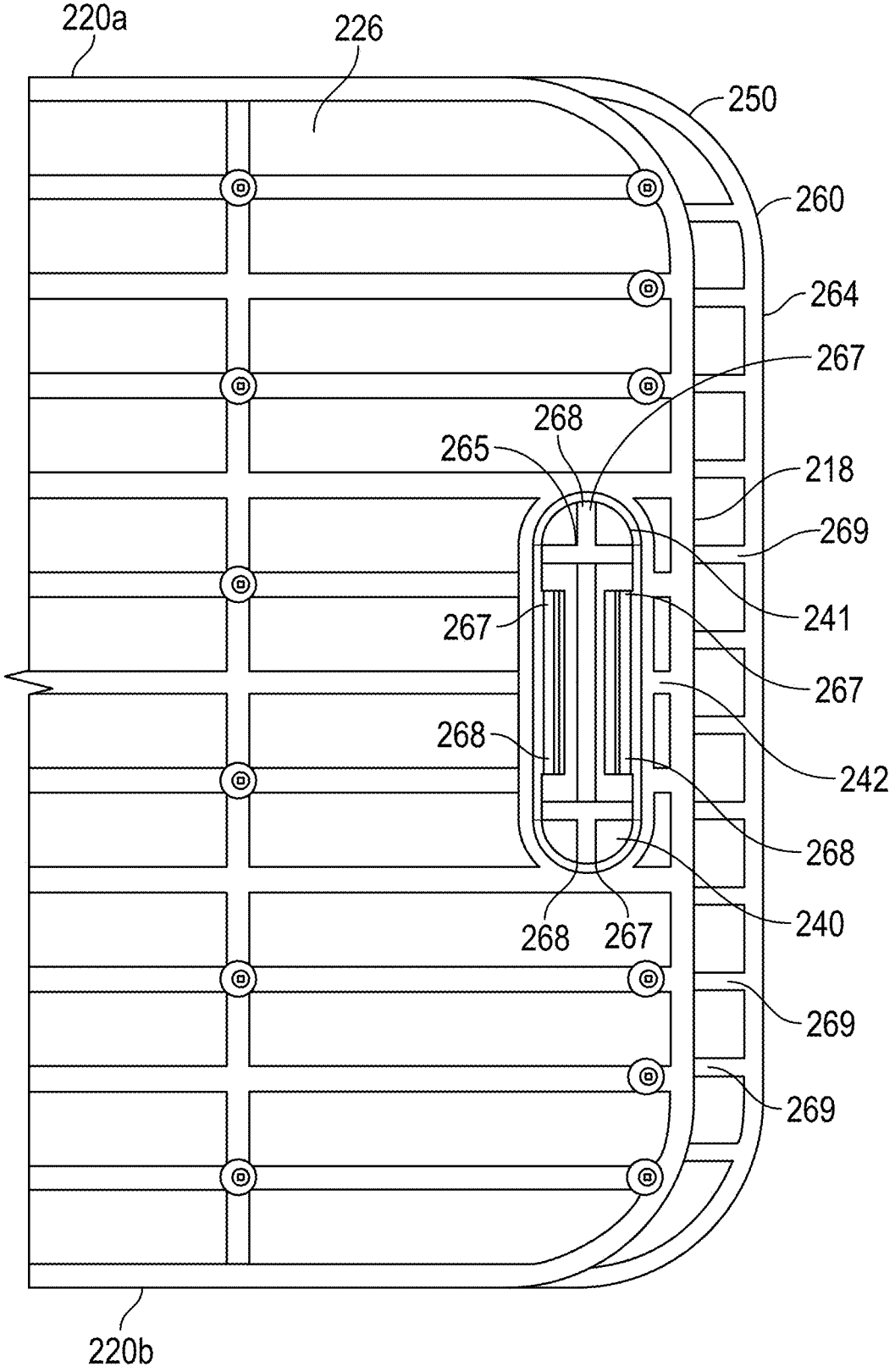
FIG. 19 show a close-up bottom view of the golf swing force shift indicator according to the second illustrated embodiment.

FIGS. 8-10 show a golf swing force shift indicator (110) with a trail foot support (150) in accordance with a first illustrated embodiment. The golf swing force shift indicator comprises top face (112) and a bottom face (114) opposite the top face wherein each of the top and bottom faces extend from a front face (116) to a rear face (118). The top face and bottom face are coupled together by a first lateral face (120*a*) and a second lateral face (120*b*). The top face comprises a first section (151) having a first continuous unitary plane (152) and a second section (153) having a second continuous unitary plane (154) wherein the second section comprises the trail foot support. The first section and second section form a top face angle (155) such that the second section inclines upward from the first section to the rear face. The top face angle is greater than 90 degrees and less than 180 degrees. A lead placement foot site (148) is disposed closer to the front face for receiving a user's lead foot. A corresponding trail placement foot site can be positioned on top of the trail foot support at the second section.

The top face (112) comprises a central recessed area (142), a first side recessed area (143), and a second side recessed area (144). Each of the recessed areas is positioned above a bottom central plane (124) and can be utilized for instructions and directions including but not limited to arrows to indicate direction and position of the lead foot placement site (148). The top face further comprises a handle opening (140) disposed between the front face (116) and the lead foot placement site to provide a convenient way of carrying and transporting the golf swing force shift indicator (110). In other embodiments, the golf swing force shift indicator may further comprise a second handle opening extending through the trail foot support from the top face and through the bottom face (114). The top face further comprises a textured surface on both the first section (151) and the second section (153) in order to provide traction to both the lead foot and the trail foot.

The bottom face (114) further comprises the bottom central plane (124), a bottom front plane (122), and a bottom rear plane (126) wherein the bottom central plane is disposed between the bottom front plane and the bottom rear plane. The bottom face extends from the rear face (118) to the front face (116) in order of the bottom rear plane, the bottom central plane, and the bottom front plane. An intersection of the bottom rear plane and the bottom central plane forms a rearward pivot axis (132) and an intersection of the bottom front plane and the bottom central plane forms a forward pivot axis (128). The trail foot support (150) is disposed vertically above the bottom rear plane such that the top face angle (155) is disposed between the rearward pivot axis and the rear face. The first section (151) of the top face is in parallel alignment with the bottom central plane. Furthermore, the second section (153) is at an angle, defined as askew, with the bottom central plane due to the angled relationship between the first section and the second section.

The bottom rear plane (126) comprises a bottom rear length (148) extending from the rear face (118) to the rearward pivot axis (132). Furthermore, the bottom front plane (122) comprises a bottom front length (147) extending from the front face (116) to the forward pivot axis (128). The bottom rear length is greater than the bottom front length to provide proper rotation of the golf swing force shift indicator during use.

The bottom face (114) comprises a plurality of projections for engagement with a ground surface. Each of the projections illustrated extends along a lateral width (146) of the bottom face. Specifically, forward projections (130) extend from the bottom face at and around the forward pivot axis (128). Rearward projections (134) extend from the bottom face at and around the rearward pivot axis (132). The bottom face further comprises rear secondary projections (157) and front secondary projections (156) disposed at the bottom rear plane (126) and the bottom front plane (122), respectively.

As shown, the trail foot support (150) is monolithically integrated with the golf swing force shift indicator (110) such that a top surface of the trail foot support comprises a portion of the top face (112). In other embodiments, the trail foot support may comprise a detachable apparatus which is configured to couple to a portion of a continuous unitary plane of a conventional top face to form the first section (151) and the second section (153) wherein the second section forms an upward slope relative to the first section. The first section is disposed vertically above an entirety of the bottom front plane (122), an entirety of the bottom central plane (124), and a portion of the bottom rear plane (126). The second section is disposed vertically above a remaining portion of the bottom rear plane.

The trail foot support (150) extends across the lateral width (146) of the top face (112) such that a width of the trail foot support equals a width of the first section (151). The trail foot support extends evenly along the lateral width wherein the intersection formed by the first section and the second section (153) is parallel to both the rear face (118) and the front face (116).

Second Illustrated Embodiment

FIG. 11-19 show a golf swing force shift indicator (210) with a trail foot support (250) in accordance with a second illustrated embodiment. The golf swing force shift indicator comprises a top face (212), a bottom face (214) opposite the top face wherein the top face couples to the bottom face by each of a front face (216), a rear face (218), a first lateral face (220*a*), and a second a lateral face (220*b*). Entirety of the top face forms a first continuous unitary plane (252) as disclosed in conventional golf swing force shift indicators. The bottom face comprises serially from the rear face to the front face a bottom rear plane (226), a bottom central plane (224), and a bottom front plane (222). The bottom central plane comprises a parallel relationship with the top face. The bottom rear plane forms a rearward pivot axis (232) with the bottom central plane wherein the bottom rear plane angles upward from the rear pivot axis to the rear face. The bottom rear plane further comprises a bottom rear length (249) extending from the rear face to the rearward pivot axis. Similarly, the bottom front plane forms a forward pivot axis (228) with the bottom central plane wherein the bottom front plane angles upward from the forward pivot axis to the front face. The bottom front plane further comprises a bottom front length (247) extending from the front face to the forward pivot axis such that the bottom front length is less than the bottom rear length.

The trail foot support (250) comprises a detachable trail foot support (260) configured to detach and reattach to the golf swing force shift indicator (210) at the rear face (218). The detachable trail foot support comprises a top surface (261) and a bottom surface (262) opposite the top surface. The top surface comprises a second continuous unitary plane (254) in sloped relationship with the bottom surface to form a front edge (263) and a back heel (264) disposed opposite the front edge. The detachable trail foot support further comprises lateral cutouts (270) disposed on opposite sides of the detachable trail foot support in order to form a flush relationship with the first and second lateral faces (220*a*; 220*b*) of the golf swing force shift indicator (210). At the bottom surface is a coupler element (265) configured to attach to a portion of the golf swing force shift indicator. As shown, the coupler element comprises a handle coupler (266) configured to engage with a handle opening (240). The coupler element includes a plurality of extensions (267) forming an outer perimeter (268) wherein the outer perimeter is configured to engage with and form a friction fit with an inner contact surface (241) of the handle opening. The bottom surface further comprises one or more support flanges (269) disposed at the back heel for engaging with the rear face (218). A gripping portion (242) is defined as the portions of the top face (212) and bottom face (214) disposed between the rear face and the handle opening. The gripping portion is positioned between the coupler element and the one or more support flanges.

The detachable trail foot support (260) is configured to detachably couple to the golf swing force shift indicator (210) such that the detachable trail foot support is disposed closer to the rear face (218) than the front face (216) and is configured to provide an improved trail foot placement site. The top surface (261) of the detachable trail foot support forms an angle with the top face (212) defined as a top face angle (255). The top face angle is greater than 90 degrees and less than 180 degrees in order to provide an inclined surface for a trail foot. A user can step on the top surface of the detachable trail foot support with the trail foot and the angled relationship between the top surface and the top face provides additional support and leverage to a golfer during a golf swing.

The front edge (263) of the detachable trail foot support (260) abuts with the top face (212) to form the top face angle (255). The back heel (264) overhangs the rear face (218) such that at least a portion of the top surface (261) is disposed vertically above the bottom rear plane (226) of the bottom face (214). Furthermore, another portion of the top surface overhangs and extends beyond the rear face. Due to the parallel alignment of the bottom central plane (224) with the top face, as well as the angled relationship of the top surface with the top face, the top surface further comprises an askew formation with the bottom central plane.

The bottom face (214) comprises a plurality of projections for engagement with a ground surface. Each of the projections illustrated extends along a lateral width (246) of the bottom face. Specifically, forward projections (230) extend from the bottom face at and around the forward pivot axis (228). Rearward projections (234) extend from the bottom face at and around the rearward pivot axis (232). The bottom face further comprises rear secondary projections (257) and front secondary projections (256) disposed at the bottom rear plane (224) and the bottom front plane (222), respectively.

The detachable trail foot support (260) extends across the lateral width (246) of the top face (212) such that a width of the detachable trail foot support equals a width of the top face to form a flush fit. The front edge (263) of the detachable trail foot support extends evenly along the lateral width wherein the top face angle (255) formed by the intersection of the top face and the front edge is parallel to both the rear face (218) and the front face (216). Both the top face and the top surface each comprise a textured surface to provide adequate traction to a golfer The top face (212) comprises a central recessed area (242), a first side recessed area (243), and a second side recessed area (244). Each of the recessed areas is positioned above the bottom central plane (224) and can be utilized for instructions and directions including but not limited to arrows to indicate direction and position of the lead foot placement site (248).

FEATURE LIST golf swing force shift indicator (10; 110; 210)
top face (12; 112; 212)
bottom face (14; 114; 214)
front face (16; 116; 216)
rear face (18; 118; 218)
first lateral face (20*a*; 120*a*; 220*a*)
second lateral face (20*b*; 210*b*; 220*b*)
bottom front plane (22; 122; 222)
bottom central plane (24; 124; 224)
bottom rear plane (26; 126; 226)
forward pivot axis (28; 128; 228)
forward projections (30; 130; 230)
rearward pivot axis (32; 132; 232)
rearward projections (34; 134; 234)
first bottom front line segment (36*a*)
second bottom front line segment (36*b*)
first bottom central line segment (38*a*)
second bottom central line segment (38*b*)
first bottom rear line segment (40)
second bottom rear line segment (40*b*)
lead foot placement site (48; 148; 248)
trail foot placement site (50)
handle opening (140; 240)
central recessed area (142; 242)
first side recessed area (143; 243)
second side recessed area (144; 244)
textured surface (145; 245)
lateral width (146; 246)
bottom front length (147; 247)
bottom rear length (149; 249)
trail foot support (150; 250)
first section (151; 251)
first continuous unitary plane (152; 252)
second section (153; 253)
second continuous unitary plane (154; 254)
top face angle (155; 255)
front secondary projections (156; 256)
rear secondary projections (157; 257)
inner contact surface (241)
gripping portion (242)
detachable trail foot support (260)
top surface (261)
bottom surface (262)
front edge (263)
back heel (264)
coupler element (265)
handle coupler (266)
plurality of extensions (267)
outer perimeter (268)
support flange (269)
lateral cutout (270)

What is claimed is:

1. A golf swing force shift indicator, comprising:

a top face, a bottom face, a front face positioned at a front end of said force shift indicator and a rear face positioned at a rear end of said force shift indicator, wherein said bottom face extends from said front end to said rear end;

a lead foot placement site disposed on the top face, the lead foot placement site having a longitudinal centerline positioned more proximal to the front end than to the rear end;

a bottom front plane, a bottom central plane, and a bottom rear plane forming said bottom face, wherein said bottom front, central and rear planes are sequentially positioned relative to one another in a series along the length of said bottom face, said bottom central plane intersects said bottom front plane along a forward pivot axis and said bottom central plane intersects said bottom rear plane along a rearward pivot axis, the bottom front plane comprising a bottom front length extending from the forward pivot axis to the front face, the bottom rear plane comprising a bottom rear length extending from the rearward pivot axis to the rear face, wherein the bottom rear length is greater than the bottom front length; and a trail foot support wherein the top face comprises a first section having a first continuous unitary plane and a second section having a second continuous unitary plane wherein the second section comprises the trail foot support, the first section extending from the front end to the second section, the second section extending from the rear end to the first section, wherein an intersection of the first section and the second section forms a top face angle.

2. The golf swing force shift indicator of claim 1, wherein the trail foot support is askew with the bottom central plane.

3. The golf swing force shift indicator of claim 1, wherein the trail foot support is disposed vertically above a portion of the bottom rear plane.

4. The golf swing force shift indicator of claim 1, wherein the top face angle is greater than 90 degrees and less than 180 degrees.

5. The golf swing force shift indicator of claim 1, wherein the trail foot support is detachable from the golf swing force shift indicator.

6. A golf swing force shift indicator, comprising:

a top face, a bottom face, a front face positioned at a front end of said force shift indicator and a rear face positioned at a rear end of said force shift indicator, wherein said bottom face extends from said front end to said rear end;

a lead foot placement site disposed on the top face, the lead foot placement site having a longitudinal centerline positioned more proximal to the front end than to the rear end; and a bottom front plane, a bottom central plane, and a bottom rear plane forming said bottom face, wherein said bottom front, central and rear planes are sequentially positioned relative to one another in a series along the length of said bottom face, said bottom central plane intersects said bottom front plane along a forward pivot axis and said bottom central plane intersects said bottom rear plane along a rearward pivot axis, the bottom front plane comprising a bottom front length extending from the forward pivot axis to the front face, the bottom rear plane comprising a bottom rear length extending from the rearward pivot axis to the rear face, wherein the bottom rear length is greater than the bottom front length;

wherein a portion of the top face is askew with the bottom central plane.

7. The golf swing force shift indicator of claim 6, wherein the portion of the top face askew with the bottom central plane is disposed vertically above a portion of the bottom rear plane.

8. The golf swing force shift indicator of claim 6, wherein the bottom central plane is parallel to a first section of the top plane and askew with a second section of the top plane.

9. The golf swing force shift indicator of claim 8, wherein the first section comprises a first continuous unitary plane and the second section comprises a second continuous unitary plane wherein the second section comprises a trail foot support, the first section extending from the front end to the second section, the second section extending from the rear end to the first section, wherein an intersection of the first section and the second section forms a top face angle.

10. The golf swing force shift indicator of claim 9, wherein the top face angle comprises an angle between and inclusive of 150 degrees and 189 degrees.

11. The golf swing force shift indicator of claim 6, further comprising a handle opening extending through the top face and the bottom rear face, the handle opening comprising an inner contact surface and a gripping portion extending from the handle opening to the rear face; and a detachable trail foot support engaged with the inner contact surface of the handle opening.

12. The golf swing force shift indicator of claim 11, wherein the detachable trail foot support comprises a top surface and a bottom surface, the top surface comprises a downward slant relative to the bottom surface to form a back heel and a front edge.

13. The golf swing force shift indicator of claim 12, wherein the back heel overhangs the rear face.

14. The golf swing force shift indicator of claim 12, wherein the front edge abuts the top face.

15. A golf swing force shift indicator kit, comprising:

a golf swing force shift indicator comprising:

a top face, a bottom face, a front face positioned at a front end of said force shift indicator and a rear face positioned at a rear end of said force shift indicator, wherein said bottom face extends from said front end to said rear end;

a lead foot placement site disposed on the top face, the lead foot placement site having a longitudinal centerline positioned more proximal to the front end than to the rear end; and a bottom front plane, a bottom central plane, and a bottom rear plane forming said bottom face, wherein said bottom front, central and rear planes are sequentially positioned relative to one another in a series along the length of said bottom face, said bottom central plane intersects said bottom front plane along a forward pivot axis and said bottom central plane intersects said bottom rear plane along a rearward pivot axis, the bottom front plane comprising a bottom front length extending from the forward pivot axis to the front face, the bottom rear plane comprising a bottom rear length extending from the rearward pivot axis to the rear face, wherein the bottom rear length is greater than the bottom front length; and a detachable trail foot support.

16. The golf swing force shift indicator kit of 15, the golf swing force shift indicator further comprising a handle opening extending through the top face and the bottom rear face, the handle opening comprising an inner contact surface and a gripping portion extending from the handle opening to the rear face, wherein the detachable trail foot support is configured to engage with the inner contact surface of the handle opening.

17. The golf swing force shift indicator kit of 16, wherein the detachable trail foot support comprises a top surface and a bottom surface, the top surface comprises a downward slant relative to the bottom surface to form a back heel and a front edge.

18. The golf swing force shift indicator kit of 17, wherein the bottom surface comprises a coupler element having an outer perimeter configured to engage and form a friction fit with the inner contact surface.

19. The golf swing force shift indicator kit of 18, the detachable trail foot support further comprising one or more support flanges disposed at the back heel, wherein each of the one or more support flanges is configured to engage and form a friction with the rear face.

20. The golf swing force shift indicator kit of 18, wherein the gripping portion is configured to be disposed between the coupler element and the one or more support flanges.

* * * * *